US009908327B2

(12) United States Patent
Choy et al.

(10) Patent No.: US 9,908,327 B2
(45) Date of Patent: Mar. 6, 2018

(54) PRINTHEAD ASSEMBLY

(71) Applicant: HEWLETT-PACKARD DEVELOPMENT COMPANY, L.P., Houston, TX (US)

(72) Inventors: Silam J Choy, Corvallis, OR (US); Peter James Fricke, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/303,998

(22) PCT Filed: Apr. 23, 2014

(86) PCT No.: PCT/US2014/035083

§ 371 (c)(1),
(2) Date: Oct. 13, 2016

(87) PCT Pub. No.: WO2015/163862

PCT Pub. Date: Oct. 29, 2015

(65) Prior Publication Data

US 2017/0028713 A1 Feb. 2, 2017

(51) Int. Cl.
*B41J 2/045* (2006.01)
*B41J 2/14* (2006.01)

(52) U.S. Cl.
CPC ..... *B41J 2/04541* (2013.01); *B41J 2/04581* (2013.01); *B41J 2/1404* (2013.01); (Continued)

(58) Field of Classification Search
CPC .. B41J 2/04541; B41J 2/04581; B41J 2/1404; B41J 2/14201; B41J 2/1433
See application file for complete search history.

(56) References Cited

U.S. PATENT DOCUMENTS 5,063,655 A 11/1991 Lamey
6,945,632 B2 9/2005 Nakamura et al.
(Continued)

FOREIGN PATENT DOCUMENTS

JP 2001212995 8/2001
KR 20060125859 12/2006
WO WO-2013165335 A1 11/2013

OTHER PUBLICATIONS

Wijshoff, H.; The Dynamics of the Piezo inkjet Printhead Operation; http://www.sciencedirect.com/science/article/pii/S0370157310000827 >; Jun. 2010.

*Primary Examiner* — Lamson Nguyen
(74) *Attorney, Agent, or Firm* — HP Inc. Patent Department

(57) ABSTRACT

In one example, a printhead assembly includes multiple printheads arranged along a line in a staggered configuration in which each printhead in a group of far printheads overlaps a printhead in a group of near printheads. Each printhead includes a pedestal, a printhead die mounted to the pedestal, an IC to drive fluid ejector elements in the printhead die, and a flex circuit. The IC is connected to the printhead die and mounted to the pedestal next to the die. The body of a flex circuit is connected to and covers the IC. The tail of each flex circuit from a far printhead extends past a pedestal in a near printhead.

12 Claims, 5 Drawing Sheets

(52) U.S. Cl.
CPC ..... *B41J 2/1433* (2013.01); *B41J 2/14201* (2013.01); *B41J 2002/14491* (2013.01); *B41J 2202/20* (2013.01)

(56) References Cited

U.S. PATENT DOCUMENTS

| | | | | |
|---|---|---|---|---|
| 7,255,428 | B2 | 8/2007 | Hara | |
| 7,452,057 | B2 * | 11/2008 | Essen | B41J 2/14072 347/50 |
| 7,654,640 | B2 | 2/2010 | Brown et al. | |
| 2013/0083120 | A1 | 4/2013 | Choy | |

* cited by examiner

PRINTHEAD ASSEMBLY

BACKGROUND

Piezoelectric inkjet printheads use piezoelectric actuators that change shape to generate pressure pulses inside ejection chambers to force fluid out through nozzles. Rex circuits are often used to carry electrical signals to the printheads to drive the piezoelectric actuators.

DRAWINGS

FIG. 1 illustrates one example of a new a printhead assembly such as might be used in an inkjet printer pen or print bar.

FIG. 2 includes an exploded view of one of the printheads in the printhead assembly shown in FIG. 1.

The same part numbers designate the same or similar parts throughout the figures.

DESCRIPTION

A new piezoelectric inkjet printhead architecture has been developed to substantially increase the density of nozzles that can be integrated into each printhead. Driver ICs located immediately adjacent to the printhead die include amplifiers for each piezoelectric actuator and provide a drive waveform tuned to each actuator's electromechanical response. A printhead assembly with a new mounting scheme and flex circuit interconnect has been developed to support the new high nozzle density printhead architecture. In one example, multiple printheads are arranged along a line in a staggered configuration in which each printhead in a group of far printheads overlaps a printhead in a group of near printheads. In this example, each printhead in the assembly includes a pedestal, a printhead die mounted to the pedestal, a pair of ICs connected to the printhead die to drive fluid ejector elements in the die, and a flex circuit connected to the ICs. The ICs are mounted to the pedestal on opposite sides of the printhead die, in plane with and immediately adjacent to the die. The flex circuit has a body and a tail extending from the body in the same direction as all of the other flex circuit tails. The body of the flex circuit surrounds the printhead die and covers the ICs, and the tail of each flex circuit in a far printhead extends past a pedestal in a near printhead.

The pedestals provide a sufficiently large platform to mount two ICs and the flex circuit while still allowing the flex circuits from far printheads to pass the near printheads so that all flex circuits can be efficiently routed to a single PCA on one side of the printhead assembly. The body of the flex circuit surrounding the printhead die enables routing signal traces to ICs on both sides of the die through a single tail on one side of the die. Also, the exposed exterior of the flex circuit body surrounding each printhead die may be used as a capping surface to seal the fluid dispensing nozzles when the printhead is capped during periods of inactivity, thus eliminating the need for an additional shroud or other discrete part to provide the capping surface.

Examples of the new printhead assembly are not limited to piezoelectric inkjet printing, but may be implemented in thermal inkjet and other inkjet type dispensing devices. The examples shown in the Figures and described herein illustrate but do not limit the disclosure, which is defined in the Claims following this Description.

As used in this document, a "printhead die" means that part of an inkjet printer or other inkjet type dispenser that can dispense fluid from one or more openings; and an "IC" means an integrated circuit. A "printhead die" is not limited to printing with ink and other printing fluids but also includes inkjet type dispensing of other fluids and/or for uses other than printing.

Figure 1:
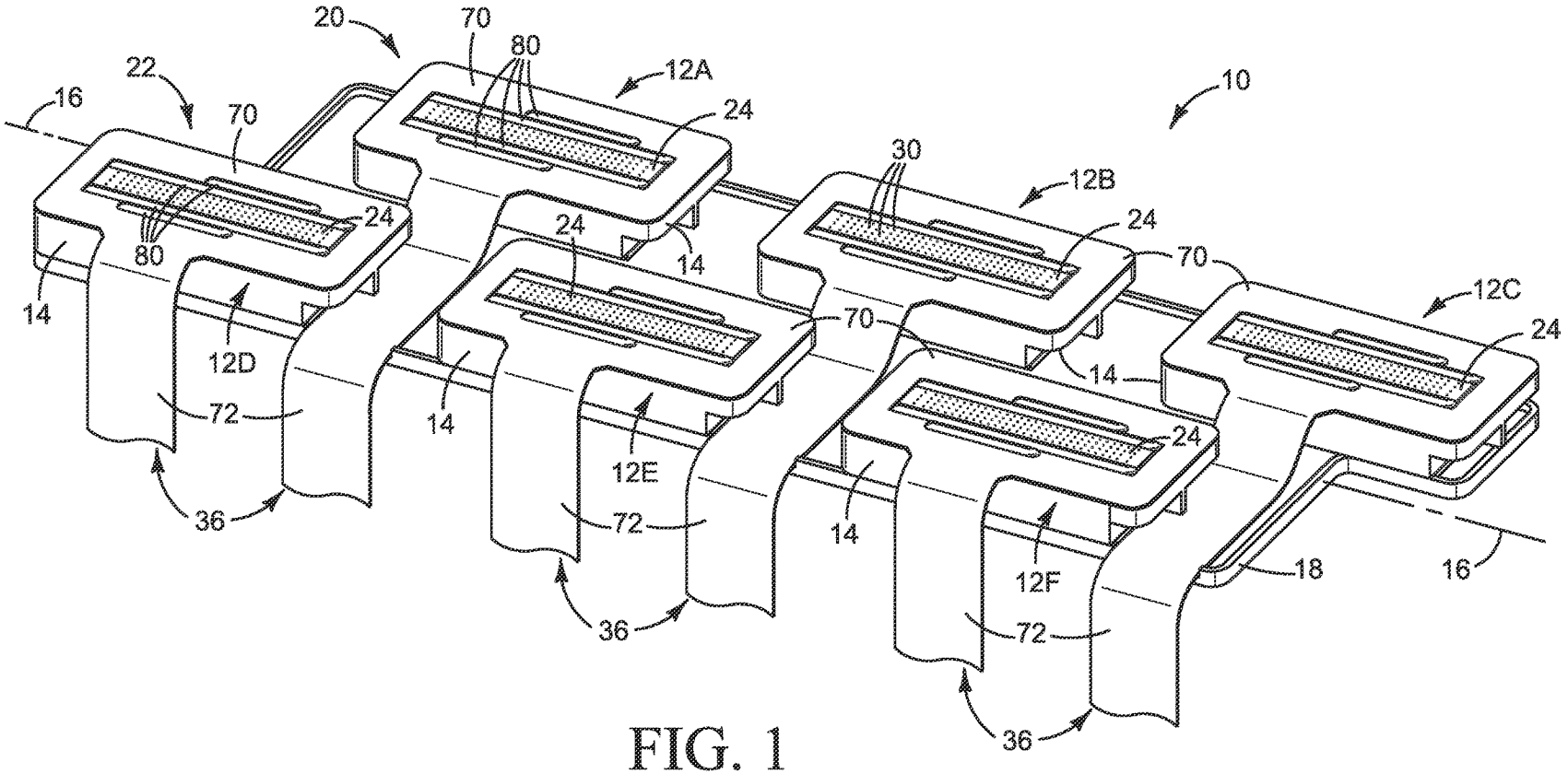

FIG. 1 illustrates a printhead assembly 10 such as might be used in an inkjet pen or print bar. Printhead assembly 10 is shown face-up in FIG. 1 to more clearly show some features of the assembly. A printhead assembly 10 usually would be oriented face-down when installed in a printer. Referring to FIG. 1, printhead assembly 10 includes printheads 12A-12F mounted to pedestals 14 along a line 16 in a staggered configuration in which each printhead overlaps another printhead. In the example shown, each printhead 12A-12F is mounted to an individual pedestal 14 affixed to a frame 18. Each printhead in a group 20 of far printheads 12A, 12B, 12C overlaps a printhead in a group 22 of near printheads 12D, 12E, 12F. Other arrangements for a printhead assembly 10 are possible. For example, more or fewer printheads could be used and/or in a different configuration.

Figure 2:
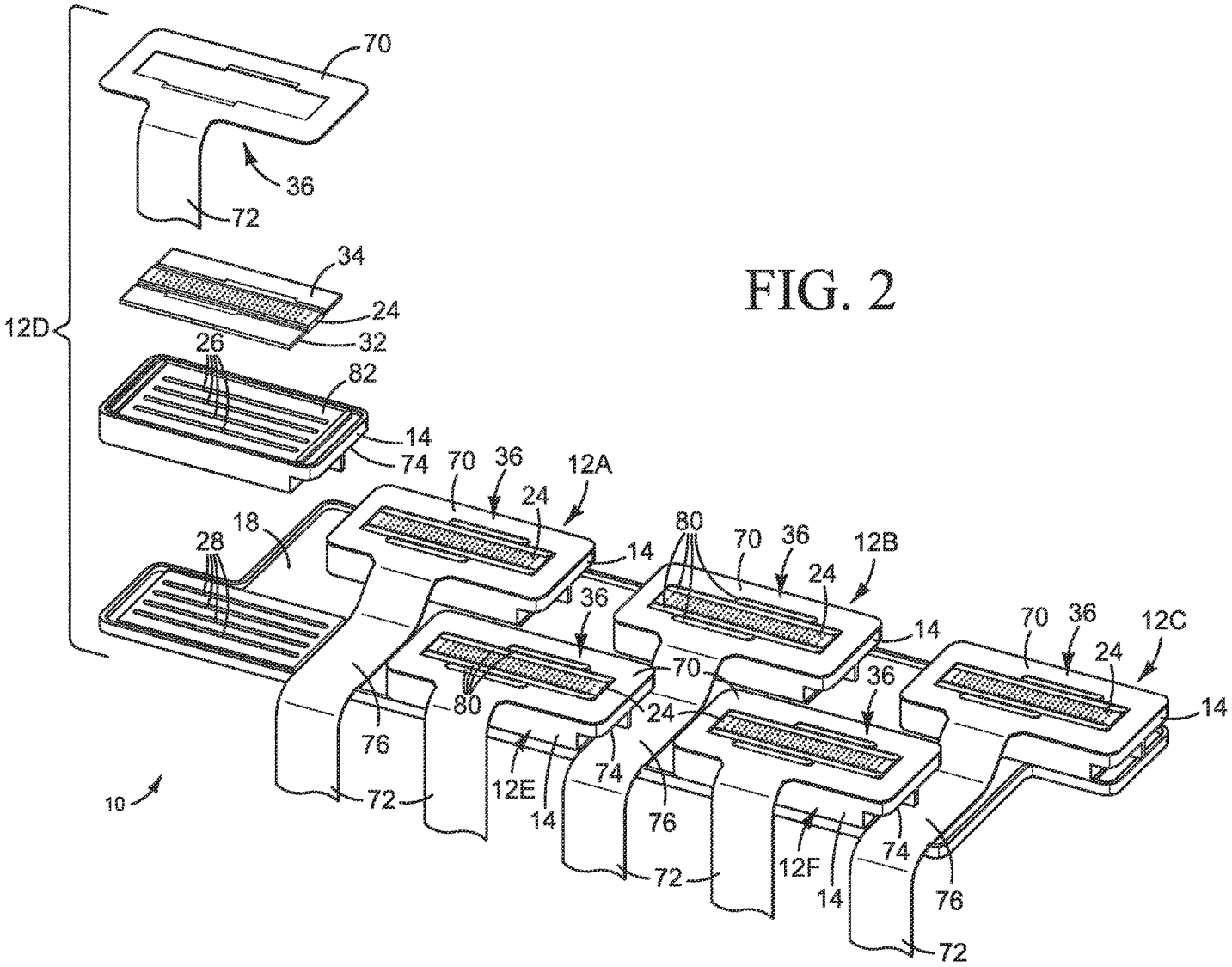

FIG. 2 includes an exploded view of printhead 12F in printhead assembly 10. FIGS. 3-6 show printhead 12F in more detail. In the example shown, each printhead 12A-12F is assembled with the same components. Indeed, one of the advantages of a printhead assembly 10 such as that shown in the figures is the ability to use interchangeable parts. Referring to FIGS. 2-6, a printhead die 24 is mounted to a corresponding pedestal 14. Ink or other printing fluid is supplied to each die 24 through channels 26, 28 in pedestal 14 and frame 18. Ink or other printing fluid is dispensed from each printhead die 24 through nozzles 30. In this example, four supply channels 26, 28 correspond to four arrays 29 of dispensing nozzles 30.

An inkjet printhead die 24 is a typically complex MEMS (microelectromechanical system) formed on a silicon substrate. In the example shown in the figures, fluid ejector elements and other components in each printhead die 24 are electrically connected to ASICs (application specific integrated circuits) or other suitable driver ICs 32, 34 located immediately adjacent to die 24. Each IC 32, 34 is connected to a printer controller or other source of power and control signals through traces (not shown) in a flex circuit 36. The electrical connections between die 24 and ICs 32, 34 and between ICs 32, 34 and connections to flex circuit 36 may be made, for example, with wire Bonds—tiny wires (not shown) connecting bond pads 38 on die 24 to bond pads 40 on ICs 32, 34 and connecting bond pads 42 on ICs 32, 34 to bond pads 44 on flex circuit 36. For clarity, the hundreds or even thousands of signal traces and bond wires are not shown, and a reduced number of the equally numerous individual bond pads 38-44 are exaggerated in size on die 24. ICs 32, 34 and flex circuit 36. Although any suitable technique may be used to make the electrical connections among die 24, ICs 32, 34 and flex circuit 36, wire bonds may be desirable in many implementations because wire bonding technology is well developed to accurately form and connect the small, high density bond pads needed to support higher density nozzle arrays on die 24.

Figure 3:
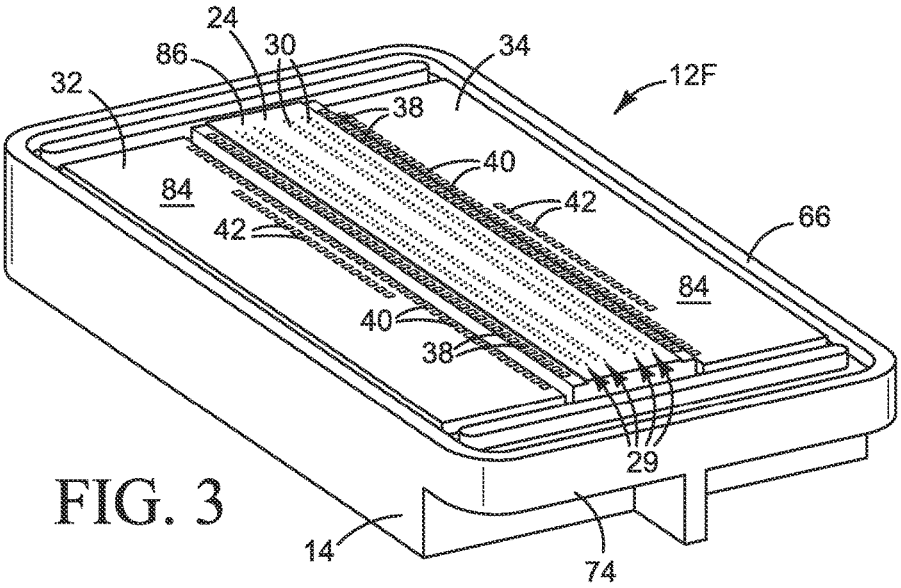
FIGS. 3-6 show a printhead from the assembly of FIG. 1 in more detail.
Figure 7:
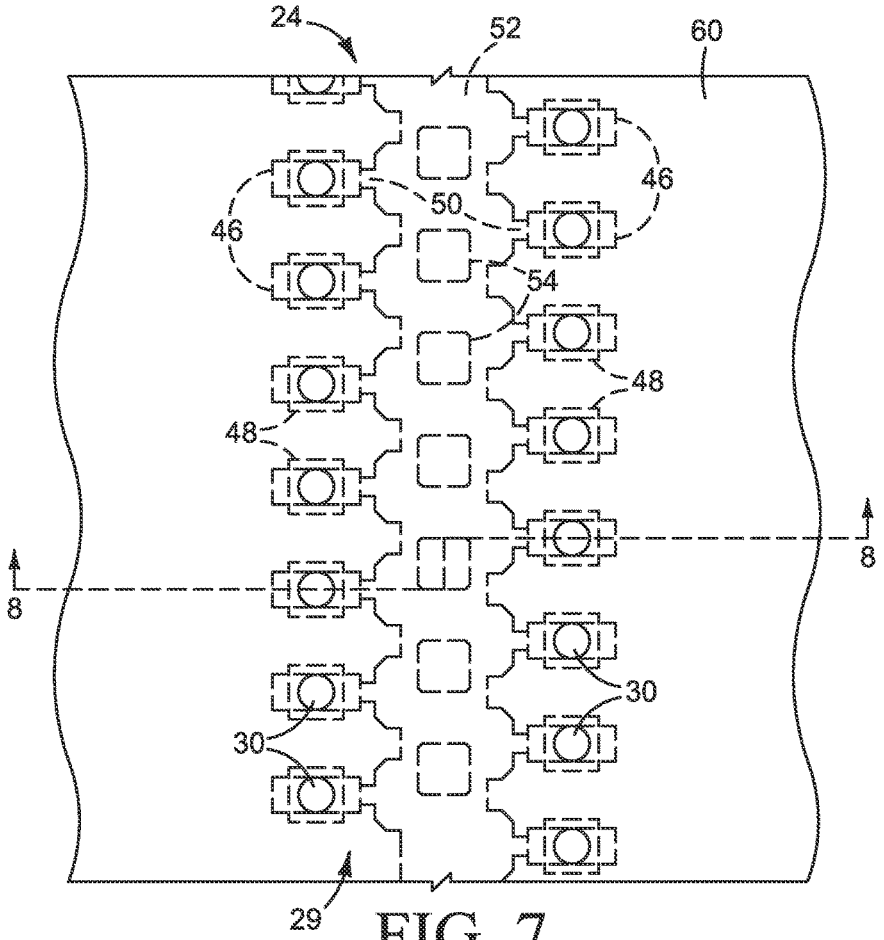
FIG. 7 is a plan view detail of part of a printhead die in the printhead shown in FIG. 3.
Figure 8:
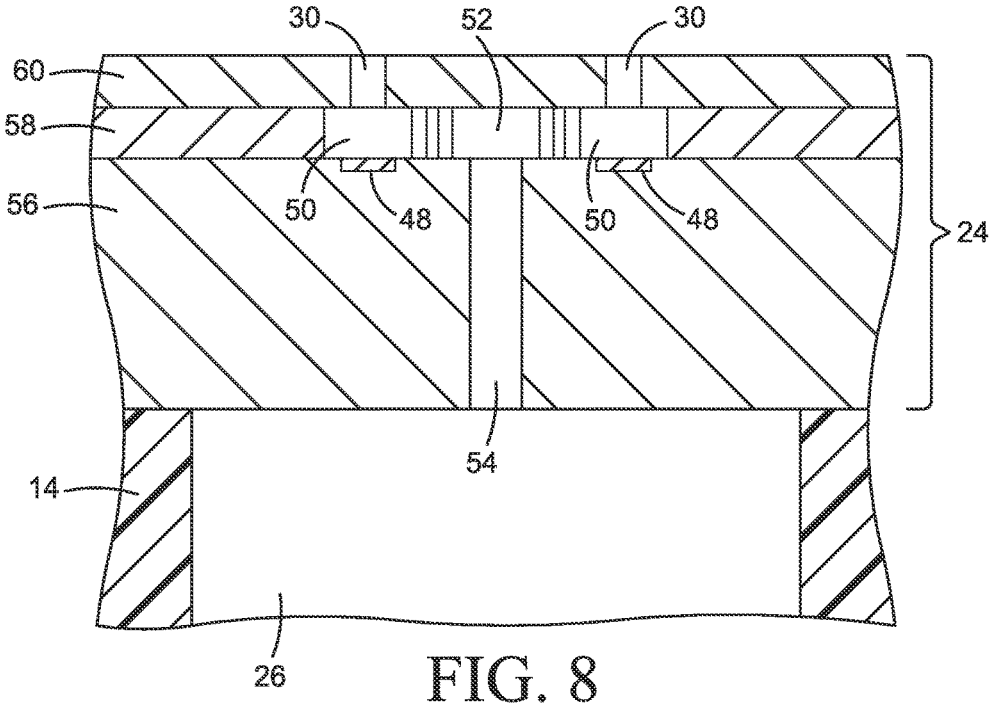
FIG. 8 is a section taken along the line 8-8 in FIG. 7.

As best seen in FIG. 3, each printhead die 24 is mounted to a center part of pedestal 14. FIG. 7 is a plan view detail from FIG. 3 showing one nozzle array 29 on printhead die 24. FIG. 8 is a section taken along the line 8-8 in FIG. 7.

Referring now to FIGS. 7 and 8, in the example shown, each array 29 includes two rows of nozzles 30. Printing fluid is ejected from chambers 46 through corresponding nozzles 30 at the urging of a piezoelectric, thermal or other ejector element 48. Also in this example, each channel 26 in pedestal 14 supplies printing fluid to two rows of ejection chambers 46. Printing fluid flows into each ejection chamber 46 through an inlet 50 from a manifold 52 extending lengthwise along die 24 between two rows of ejection chambers 46. Printing fluid feeds into manifold 52 through multiple ports 54 that are connected to a printing fluid supply channel 26. Other suitable configurations for printhead dies 24 and channels 26 are possible. For example, more or fewer channels 26 supplying more or fewer ejection chambers 46. Also, the idealized representation of a printhead die 24 in FIGS. 7 and 8 depicts three layers (substrate 56, chamber layer 58, and nozzle plate 60) for convenience only to clearly show nozzles 30, ejection chambers 46, inlets 50, manifold 52, and ports 54. An actual inkjet printhead die 24 may include fewer or more layers than those shown and/or different paths for supplying fluid to ejection chambers 46.

Figure 4:
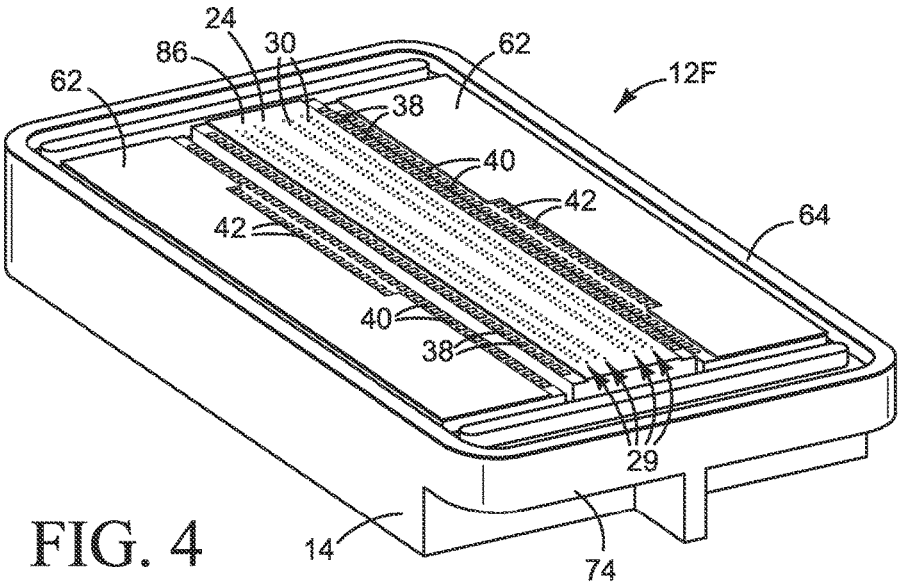
Figure 5:
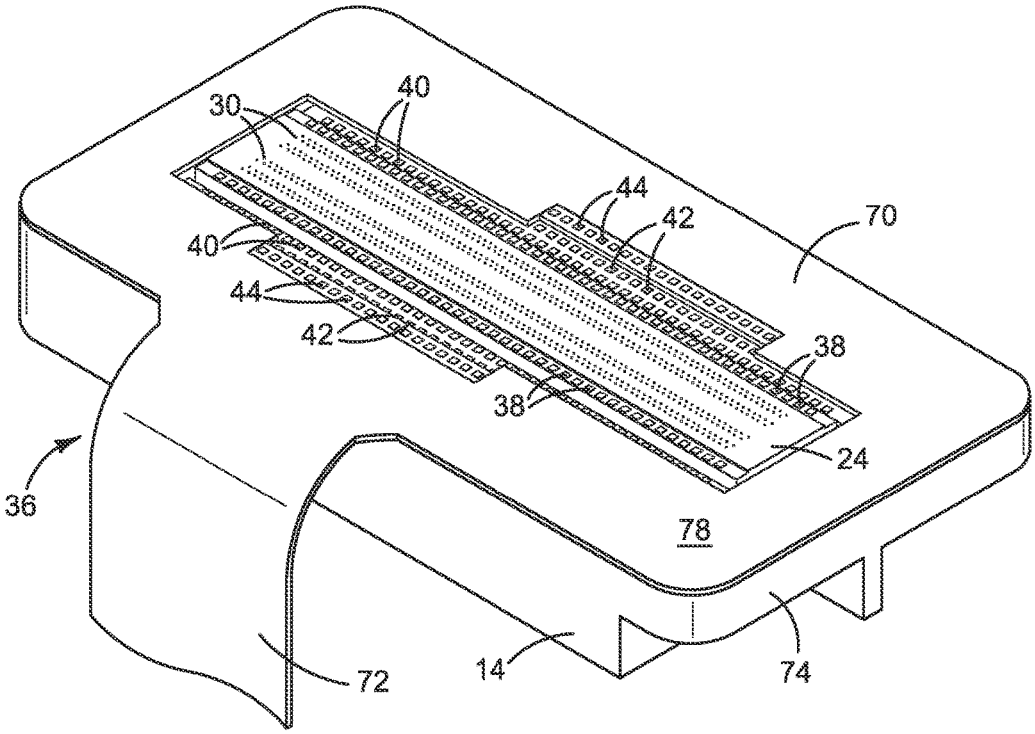

Referring again to FIG. 3, each IC 32, 34 is mounted to pedestal 14 laterally adjacent to die 24. Each IC 32, 34 is electrically connected to and physically flanks one side of printhead die 24, for example to drive ejector elements in die 24 corresponding to the two nozzle arrays 29 closest to the IC 32, 34. As shown in FIG. 5, flex circuit 36 is affixed to pedestal 14 covering ICs 32, 34. Any suitable technique may be used to affix flex circuit 36 to pedestal 14, for example a film adhesive 62 applied to ICs 32 and 34 and an adhesive paste 64 applied to a flange 66 along the perimeter of pedestal 14, as shown in FIG. 4.

The body 70 of flex circuit 36 surrounds printhead 24 to carry signal traces from both ICs 32, 34 to a tail 72 that extends from body 70 on only one side of the printhead. The mounting surfaces bordered by perimeter flange 66 on each pedestal 14 are large enough to support flex circuit body 70 surrounding nozzle arrays 29. Accordingly, the electrical connections to all printheads 12A-12F may be located on just one side of the printhead assembly 10. Where the arrangement of pedestals 14 might otherwise obstruct routing all flex circuit tails 72 to one side of the printhead assembly 10, as shown in FIGS. 1 and 2, an overhang 74 at one end of each pedestal 14 allows the tail 72 of the flex circuits 36 on far printheads 12A-12C to pass by near printheads 12D-12F. Flex circuit tails 72 from far side printheads 12A-12C may be staked or otherwise affixed to frame 18 at locations 76 under near side pedestal overhangs 74 as desired to help relieve unwanted stresses in the flex circuits.

Figure 6:
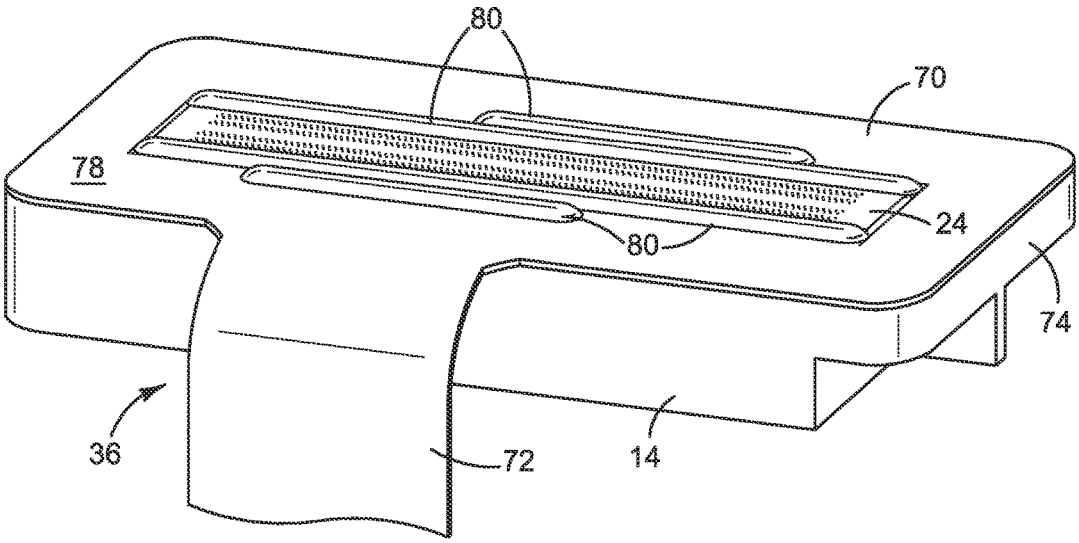

The printhead configuration shown in FIGS. 1-6, in which the body 70 of each flex circuit 36 surrounds the corresponding printhead die 24, also allows the exposed exterior 78 of flex circuit body 70 to form a capping surface to seal fluid dispensing nozzles 30 when they are capped during periods of inactivity, thus eliminating the need for a shroud or other part to provide the capping surface. As best seen in FIG. 6, the wire bonds connecting die 24, ICs 32, 34 and flex circuit 36 may be covered by an epoxy or other suitable protective material 80 as desired to protect the connections from ink and other potentially damaging environmental conditions.

As best seen in FIG. 3, ICs 32, 34 are mounted to surface 82 (FIG. 2) on pedestal 14 generally in the same plane as printhead die 24. In the example shown, each IC 32, 34 has a flat exterior surface 84 defining a plane parallel to the exposed planar face 86 of die 24. As shown in FIGS. 4 and 5, flex circuit body 70 is affixed to and covers most of the exterior surface 84 of each IC 32, 34. The relative height of ICs 32, 34 and die 24 on pedestal 14 may be adjusted to place IC surface 84 only slightly below die face 86, about 365 μm for example, to facilitate wire bonding and encapsulation.

Printhead assembly 10 may include interchangeable ICs 32, 34 oriented 180' from one another on each side of each printhead die 24. Similarly, interchangeable pedestals 14 oriented 180' from one another in far and near printhead groups 20, 22 may be used to support dies 24 and ICs 32, 34. While a pair of ICs 32, 34 flanking both sides of each die 24 is shown, other suitable configurations are possible. For example, a single drive IC flanking one side of a printhead die may be adequate in some implementations.

"A" and "an" as used in the Claims means one or more.

As noted at the beginning of this Description, the examples shown in the figures and described above illustrate but do not limit the disclosure. Other examples are possible. Therefore, the foregoing description should not be construed to limit the scope of the disclosure, which is defined in the following Claims.

What is claimed is:

1. A printhead assembly, comprising multiple printheads arranged along a line in a staggered configuration in which each printhead in a group of far printheads overlaps a printhead in a group of near printheads, each printhead including:

a pedestal;

a printhead die mounted to the pedestal;

an IC to drive fluid ejector elements in the printhead die, the IC mounted to the pedestal next to the printhead die and the IC connected to the printhead die; and a flex circuit having a body and a tail extending from the body in the same direction as all of the other flex circuit tails, the body of the flex circuit connected to and covering the IC, and the tail of each flex circuit in a far printhead extending past a pedestal in a near printhead.

2. The printhead assembly of claim 1, wherein:

the IC in each printhead comprises a pair of ICs each flanking one side of the printhead die; and the body of each flex circuit in each printhead surrounds the printhead die and covers both ICs.

3. The printhead assembly of claim 2, wherein the printhead die in each printhead comprises a single printhead die.

4. The printhead assembly of claim 1, wherein:

the printhead die in each printhead includes:

a first array of fluid ejection nozzles at a first inboard part of the die;

a second array of fluid ejection nozzles at a second inboard part of the die;

first bond pads at a first outboard part of the die; and second bond pads along a second outboard part of the die opposite the first outboard part; and the pair of ICs in each printhead includes:

a first IC to drive first fluid ejector elements in the die corresponding to the first nozzles, the first IC flanking the first outboard part of the die and having first bond pads and second bond pads, the first IC first bond pads connected to the die first bond pads and the first IC second bond pads connected to the body of the flex circuit; and a second IC to drive second fluid ejector elements in the die corresponding to the second nozzles, the second IC flanking the second outboard part of the die and having first bond pads and second bond pads, the second IC first bond pads connected to the die second bond pads and the second IC second bond pads connected to the body of the flex circuit.

5. The printhead assembly of claim 4, wherein the pedestals are interchangeable with one another, or the ICs are interchangeable with one another, or the pedestals are interchangeable with one another and the ICs are interchangeable with one another.

6. The printhead assembly of claim 5, wherein an exterior of the body of each flex circuit surrounding a die forms a capping surface.

7. The printhead assembly of claim 6, wherein each pedestal includes an overhang and the tail of each flex circuit on a far printhead extends under the overhang of a pedestal on a near printhead.

8. The printhead assembly of claim 7, wherein the pedestals are mounted to a frame and the tail of each flex circuit on a far printhead is affixed to the frame at a location under the overhang of a pedestal on a near printhead.

9. A printhead assembly, comprising:

a printhead die having:

a first array of fluid ejection nozzles at a first inboard part of the die;

a second array of fluid ejection nozzles at a second inboard part of the die;

first bond pads at a first outboard part of the die; and second bond pads along a second outboard part of the die opposite the first outboard part;

a first IC to drive first fluid ejector elements in the die corresponding to the first nozzles, the first IC flanking the first outboard part of the die and having first bond pads and second bond pads, the first IC first bond pads connected to the die first bond pads;

a second IC to drive second fluid ejector elements in the die corresponding to the second nozzles, the second IC flanking the second outboard part of the die and having first bond pads and second bond pads, the second IC first bond pads connected to the die second bond pads; and a flex circuit having a body and a tail extending from the body, the flex circuit body surrounding the die, covering the first and second ICs, and having first bond pads connected to the first IC second bond pads and second bond pads connected to the second IC second bond pads.

10. The printhead assembly of claim 9, further comprising a pedestal, the die and the ICs mounted to the pedestal, the pedestal having passages therein through which fluid may pass to the die for ejection through the nozzles and the tail of the flex circuit extending from one side of the pedestal.

11. A printhead assembly, comprising:

a mounting surface;

a rectangular printhead die mounted directly to the mounting surface, the die having fluid ejection nozzles arrayed on an exposed planar face of the die opposite the mounting surface; and an IC electrically connected to the die to drive fluid ejector elements in the die corresponding to the nozzles, the IC mounted directly to the mounting surface next to one side of the die and the IC having a flat exterior surface defining a plane parallel to the face of the die, wherein the surface plane of the IC is 365 μm or less from the face of the die in a direction perpendicular to the plane.

12. The printhead assembly of claim 11, further comprising a flex circuit supported on the exterior surface of the IC and wherein the IC is electrically connected to the die through the flex circuit.

* * * * *